US005208639A

United States Patent [19]

Thayer et al.

[11] Patent Number: 5,208,639

[45] Date of Patent: May 4, 1993

[54] MULTIPLE CLEANING BLADE INDEXING APPARATUS

[75] Inventors: Bruce E. Thayer, Webster; Alvin J. Owens, Jr., Rochester, both of N.Y.

[73] Assignee: Xerox Corporation, Stamford, Conn.

[21] Appl. No.: 904,094

[22] Filed: Jun. 25, 1992

[51] Int. Cl.[5] ..... G03G 21/00

[52] U.S. Cl. ..... 355/299; 15/256.52

[58] Field of Search ..... 355/299, 296, 297; 15/236.05, 236.10, 256.50, 256.51, 256.52

[56] References Cited

U.S. PATENT DOCUMENTS

| | | | |
|---|---|---|---|
| 3,706,108 | 12/1972 | Taylor | 15/1.51 |
| 3,947,108 | 3/1976 | Thettu et al. | 355/297 |
| 4,202,437 | 5/1980 | Gordon | 15/256.5 |
| 4,364,660 | 12/1982 | Oda | 355/297 |
| 4,451,139 | 5/1984 | Yanagawa et al. | 355/297 |
| 4,989,047 | 1/1991 | Jugle et al. | 355/297 |
| 5,081,505 | 1/1992 | Ziegelmuller et al. | 355/299 |
| 5,111,251 | 5/1992 | Uno et al. | 355/297 |

FOREIGN PATENT DOCUMENTS

| | | | |
|---|---|---|---|
| 0002035 | 1/1969 | Japan | 355/299 |
| 0103180 | 5/1986 | Japan | 355/299 |
| 0122679 | 6/1986 | Japan | 355/299 |
| 0245181 | 10/1986 | Japan | 355/299 |
| 1523424 | 8/1978 | United Kingdom | 355/299 |

*Primary Examiner*—Joan H. Pendegrass
*Assistant Examiner*—Robert Beatty
*Attorney, Agent, or Firm*—Oliff & Berridge

[57] ABSTRACT

An apparatus for cleaning residual toner and debris from a moving charge retentive surface of an image forming apparatus includes a multiple turret style blade holder located such that an individual blade is selectively indexed into optimum position for cleaning the moving photoreceptor. The blade holder contains a number of cleaning blades mounted radially from a central core and by rotating the holder about its longitudinal axis a specified number of degrees (360°/number of cleaning blades on the holder) a new cleaning blade is moved by the indexing device into the cleaning position to replace a failed blade. The indexing device removes the failed cleaning blade and positions a new cleaning blade in frictional contact with the photoreceptor for cleaning.

26 Claims, 7 Drawing Sheets

MULTIPLE CLEANING BLADE INDEXING APPARATUS

BACKGROUND OF THE INVENTION

1. Field of the Invention

This invention relates to electrophotographic image forming apparatus, and more particularly to cleaning devices for removing residual toner and debris from a charge retentive surface of an image forming device.

2. Description of Related Art

In electrophotographic applications such as xerography, a charge retentive surface of a photoreceptor is electrostatically charged, and exposed to a light pattern of an original image to be reproduced, to selectively discharge the photoreceptive surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as toner. Toner is held on the image areas by the electrostatic charge on the surface. Thus, a toner image is produced in conformity with a light image of the original beam reproduced. The toner image may then be transferred to a substrate (e.g., paper), and the image affixed thereto to form a permanent record of the image to be reproduced. The process is well known, and is useful for light lens copying from an original, and printing applications from electronically generated or stored originals, where a charged surface may be discharged in a variety of ways. Ion projection devices where a charge is imagewise deposited on a charge retentive substrate operate similarly.

Multicolor electrophotographic printing is substantially identical to the foregoing process of black and white printing. However, rather than forming a single latent image on the photoreceptor, successive latent images corresponding to different colors are recorded thereon. Each single color electrostatic latent image is developed with toner of a color complimentary thereto. This process is repeated in a plurality of cycles for differently colored images and their respective complimentary colored toner. Each single color toner image is transferred to the copy sheet in superimposed registration with the prior toner image. This creates a multilayered toner image on the copy sheet. Thereafter, the multilayered toner image is permanently affixed to the copy sheet as described above to create a color copy. The developer material (toner) may be a liquid material or powder material.

Although, a preponderance of the toner forming the image is transferred to the paper during transfer, some toner invariably remains on the charge retentive surface of the photoreceptor, it being held thereto by relatively high electrostatic and/or mechanical forces. Additionally, paper fibers, toner additives, kaolins and other debris have a tendency to be attracted to the charge retentive surface. It is essential for optimal imaging that the toner and debris remaining on the surface be cleaned thoroughly therefrom.

The quality of images produced by such equipment depends significantly on the ability to clean the photoconductive surface before it is reused.

Blade cleaning is a highly desirable method for removal of residual toner and debris (hereinafter, collectively referred to as "toner") from a photoreceptor. In a typical application, a relatively thin elastomeric blade member is provided and supported adjacent to and transversely across the photoreceptor surface with a blade edge chiseling (doctor mode) or wiping (wiper mode) toner from the surface. Subsequent to release of toner from the surface, the released toner accumulating adjacent to the blade is transported away from the blade area by a toner transport arrangement, or by gravity.

However, the blades are subject to wear and thus must be replaced. The need for replacement is unpredictable and usually requires a technician.

Accordingly, to simplify blade replacement and minimize technician service, a need exists for a multiple blade apparatus for cleaning residual toner and debris from the moving charge retentive surface of an image forming apparatus, such that the blade holder of the multiple cleaning blade indexing apparatus is capable of positioning, loading and aligning each blade within allowable tolerances (as known in the art, tolerances are determined separately for applicable electrophotographic apparatuses). That is, the blade angle to the photoreceptor, blade load against the photoreceptor and alignment of the blade edge to the photoreceptor must be within operational tolerance zones. Further, the blade angle and blade load requirements demand that the blade be locked into position after indexing, and the blade edge alignment requirement dictates that the blade must be free to pivot and align itself to the photoreceptor plane with no interference from the indexing mechanism.

A number of cleaning apparatuses for photoreceptors which employ a cleaning blade are known.

U.S. Pat. No. 5,081,505, to Ziegelmuller et al., discloses a rotatable wiper blade roller for cleaning residual toner particles from an image bearing surface and includes a plurality of indexable wiper blades. The blades engage the image bearing surface at an angle of 60° to 85° defined in the direction of particle removal by the cleaning edge of each such blade and image-bearing surface. The blades are cleaned secondarily by an intermittently rotatable fur brush that is completely out of contact with the image bearing surface.

U.S. Pat. No. 4,989,047, to Jugle et al., discloses a photoreceptor cleaning apparatus for the reduction of agglomeration caused spotting. A thin scraper member arranged at a low angle to the photoreceptor is provided as a secondary cleaning device to a rotating negatively biased fiber brush which contacts the surface of the photoreceptor upstream of the blade to remove most of the adhering toner particles. The rotating brush removes the preponderance of toner from the photoreceptor, and the blade removes any toner agglomerates formed on the photoreceptor by the agglomeration of toner.

U.S. Pat. No. 4,364,660, to Oda, discloses a photoreceptor cleaning system having a cleaning blade which removes toner from a photoreceptor. A fur brush located upstream of the cleaning blade acts as a toner recovery mechanism to recover toner removed from the photoreceptor by the cleaning blade.

U.S. Pat. No. 4,451,139, to Yanagawa et al., discloses a cleaning apparatus for a photoreceptor which includes an elastic polyurethane cleaning blade located downstream of a rotating fur brush with respect to the rotation direction of the photoreceptor.

U.S. Pat. No. 3,947,108, to Thettu et al., discloses a photoreceptor cleaning system wherein a blade acts as a primary cleaning member. A brush located downstream of the blade removes the residual film from the photoreceptor not removed by the blade.

SUMMARY OF THE INVENTION

It is thus an object of the invention to obviate the foregoing drawbacks of the prior art by providing a more efficient apparatus for removing residual toner and debris from the charge retentive surface of a moving photoreceptor.

Another object of the invention is to provide a multiple cleaning blade indexing apparatus for removing residual toner and debris from the charge retentive surface of a moving photoreceptor.

These and other objects and advantages are obtained by the inventive apparatus for cleaning a charge retentive surface of a photoreceptor which includes a multiple turret style cleaning blade holder which has a plurality of cleaning blades mounted radially from a central core. By rotating the holder about its core axis a specified number of degrees (360° divided by the number of cleaning blades on the holder), a new cleaning blade can be moved into the cleaning position as the failed blade is retracted and moved away for replacement. Note that for most photoreceptor architectures, blade holders of more than a few blades (2–4) are impractical in the doctor mode.

This invention, therefore, while applicable to a turret style doctor blade holder will be concerned preferably with wiper blade holders since many more blades may be accommodated. Support and loading means are provided for supporting and loading the blade holder and include two movable support arms, pivotally attached to two end plates of the cleaning apparatus, to which the blade holder is removably and rotatably attached. A detent disk is disposed outside a first support arm and non-rotatably compression spring mounted to the blade holder mounting extension to ensure the blade holder maintains proper blade load, angle and blade edge alignment. Additionally, the detent disk has a plurality of detents and attached index pins, one of each for every blade on the blade holder.

A means for lifting and lowering the support arms and blade holder is provided to facilitate the indexing of a new cleaning blade into a cleaning position and retracting a failed blade from frictional contact with the photoreceptor surface for replacement. As the support arms and blade holder are lifted, a first index pin on the detent disk contacts a pawl which is attached to a first cleaner end plate. The pawl is positioned against a stop and unable to rotate away from the index pin, so the index pin is forced, by movement of the support arms and blade holder, to ride up the pawl until clearing the top portion of the pawl. This results in the detent disk rotating counterclockwise relative to the support arm thereby causing detent pins to move out of the failed blade detents and snap into the new blade detents.

As the support arms and blade holder are lowered back toward the photoreceptor surface, an index pin again contacts the pawl. Now, however, the lightly spring loaded pawl swings out of the way since, in this direction, only minimal resistance to the returning support arms and blade holder is provided by the pawl. The pawl is no longer in contact with the detent disk, until the next time the support arms and blade holder are lifted, and the new blade comes into frictional contact with the photoreceptor surface. This allows the blade to freely align with the photoreceptor plane.

Additionally, the cleaning blade is placed in frictional contact with the photoreceptor surface such that blade angle, load and alignment of the blade edge to the photoreceptor are all within the operational tolerance zones. To do this, the support means comprises two support arms which are free to pivot about the support arm pivot axis independently of the blade holder, with a blade load weight provided to transfer a force through the support arms to supply a cleaning blade load, i.e., the force applied to the blade tip normal to the photoreceptor surface. Further, the detent disk disposed outside the first support arm and non-rotatably compression spring mounted to the blade holder mounting extension is configured with shaped edge detents, one per blade, to ensure that the force required to rotate the blade holder in the direction of photoreceptor travel is extremely high, effectively preventing all rotation in that direction. Conversely, blade holder rotation in a direction opposite to photoreceptor travel, for indexing, is accomplished with only minimal force. Further, the detents are oriented to align with an axis parallel to the plane of the photoreceptor thereby allowing the blade holder to pivot about the blade holder pivot axis and align itself freely with the photoreceptor plane. The detents also serve to position each blade relative to the photoreceptor and the detent disk and the detent pins have either a spherical end or a prism shaped pin to correspond to the detents found on the detent disk.

The lifting and replacement of the support arms can be accomplished preferably by either a single rotation cam, solenoid, worm gear or other similar means for rotating the support arms and lifting the blade holder. However, the proposed lifting means must never be disposed in such a position that contact is possible with the support arms when the cleaning blade is in the cleaning position. Additionally, the support arms are released from the lifting means when the cleaning blade is in the cleaning position to allow the blade load weight to be fully applied to loading the cleaning blade thereby ensuring blade alignment to the photoreceptor plane.

Other objects, advantages and salient features of the invention will become apparent from the following detailed description, which taken in conjunction with the annexed drawings, discloses a preferred embodiment of the invention.

BRIEF DESCRIPTION OF THE DRAWINGS

Referring now to the drawings which form a part of this original disclosure.

DETAILED DESCRIPTION OF THE PREFERRED EMBODIMENTS

The multiple cleaning blade indexing apparatus for cleaning a moving photoreceptor surface having particles thereon will be described in combination with a particular copier or xerographic device that uses a compliant belt photoreceptor having a charge retentive surface. However, the cleaning apparatus of the present invention may be used with any printing apparatus that includes a charge retentive surface, including multiple or single color printers. The present invention is particularly applicable to any printer containing a charge retentive surface which is subject to the retention of toner particles thereon.

Figure 9:
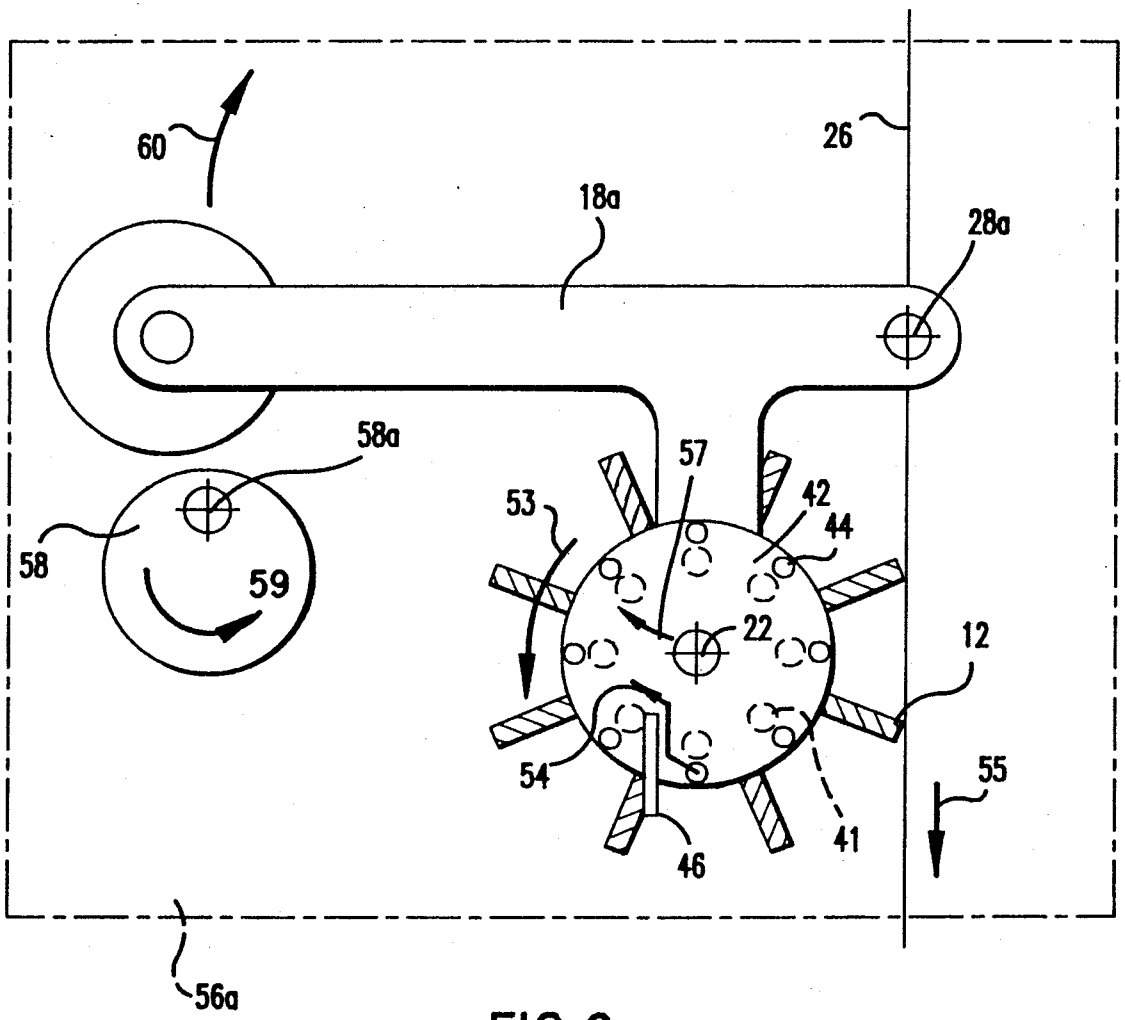
FIG. 9 is a schematic view depicting the claimed multiple cleaning blade indexing device.
Figure 10:
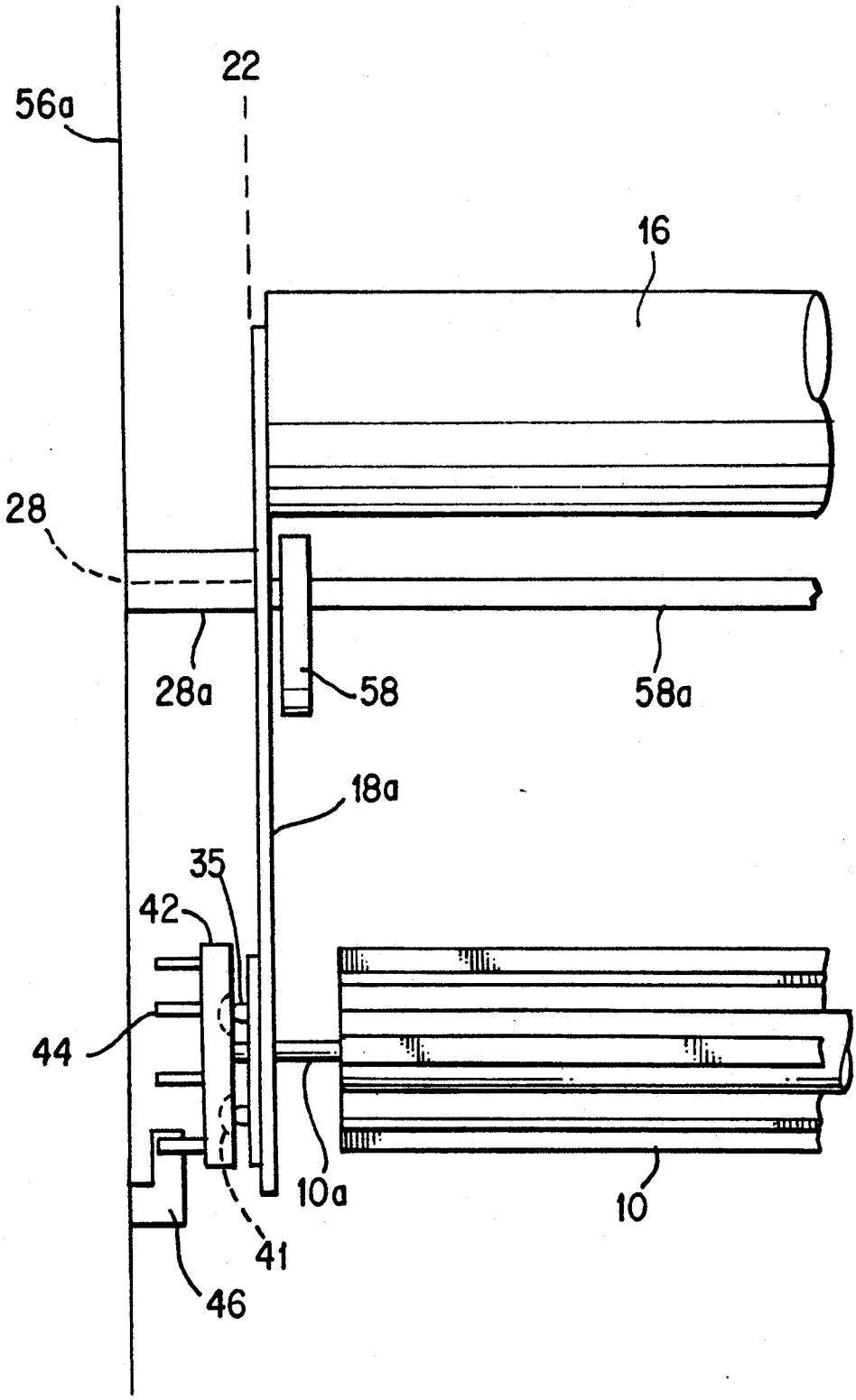
FIG. 10 is a schematic end view partially depicting the claimed device mounted in a cleaning assembly.

For a general understanding of the features of the present invention, reference is made to the drawings. In the drawings, like reference numerals have been used throughout to designate identical elements. FIGS. 9 and 10 are schematic views of an illustrative multiple cleaning blade indexing apparatus incorporating the features of the present invention therein. It will become evident from the following discussion that the present invention is equally well suited for use in a wide variety of printing systems, and is not necessarily limited in this application to the particular system shown herein.

Figure 2:
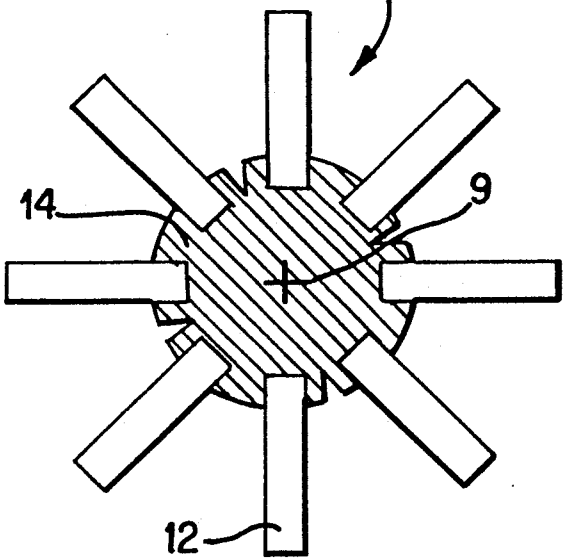
FIGS. 1 and 2 are schematic end views of two different assemblies of an eight wiper blade holder.
Figure 1:
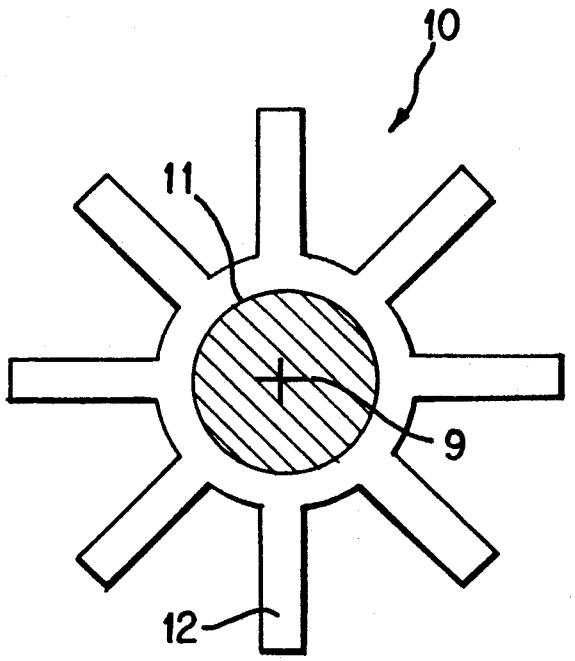

Turning initially to FIGS. 1 and 2, the proposed blade indexing mechanism uses a turret style cleaning blade holder 10. This type of blade holder contains at least two elastomeric cleaning blades 12 (shown here with eight) mounted radially from a central core 11, 14. By rotating the holder about its core axis 9 a specified number of degrees (360° divided by the number of cleaning blades on the holder) a new cleaning blade can be moved into the cleaning position. For most photoreceptor architectures, blade holders of more than a few blades (2–4) are impractical in the doctor mode. This invention, while applicable to a turret style doctor blade holder, is preferably concerned with wiper blade holders since many more blades may be accommodated. FIG. 1 shows a turret style cleaning blade holder 10 with eight elastomeric cleaning blades 12 molded to a support core 11, whereas FIG. 2 shows eight elastomeric cleaning blades 12 assembled to the support core 14.

Figure 3:
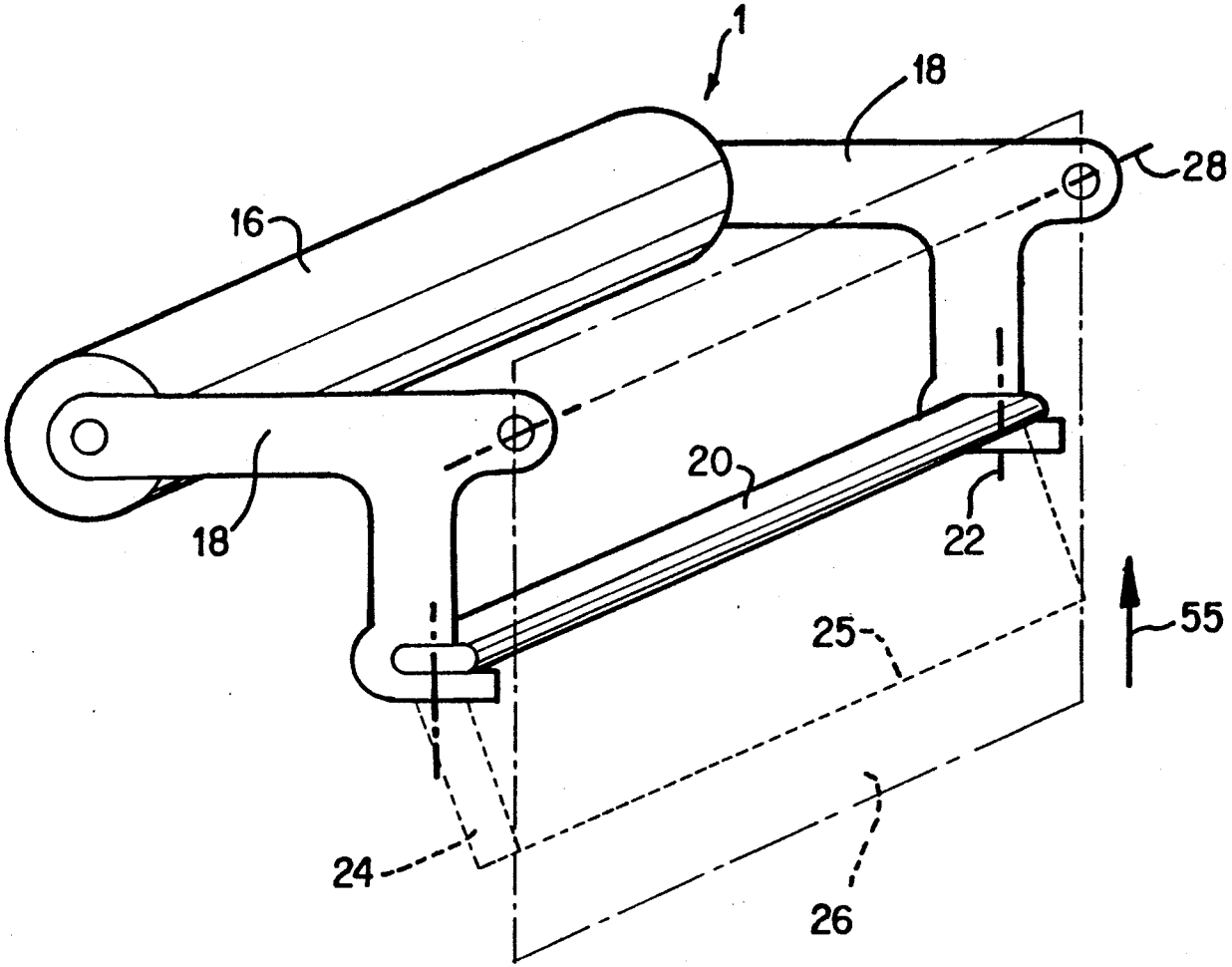
FIG. 3 PRIOR ART
FIG. 3 is a schematic elevational view depicting a blade support and loading arrangement known in the prior art.

Turning now to FIG. 3, the blade support and loading arrangement 1 used in a prior art device is shown. The blade support and loading arrangement 1 supports a single blade (a doctor blade is shown) 24 in a rigid blade holder extrusion 20 which is held between two support arms 18 pivotally attached to two end plates (not shown) of the cleaner. The support arms 18 are free to pivot independently about the support arm pivot axis 28, while the blade holder extrusion 20 can also pivot to a much smaller degree about a blade holder pivot axis 22 which is parallel to the photoreceptor plane 26. The relative degrees of freedom allowed by this arrangement enable the cleaning blade edge 25 to align itself to the photoreceptor plane 26, the photoreceptor direction of movement being indicated by arrow 55. Also attached to the support arms 18 is a blade load weight 16. This weight transfers a force through the supports to supply the cleaning blade load. The relative positions of the support arm pivot and cleaning blade within the blade holder are such as to obtain the necessary blade angle to the photoreceptor.

Figure 5:
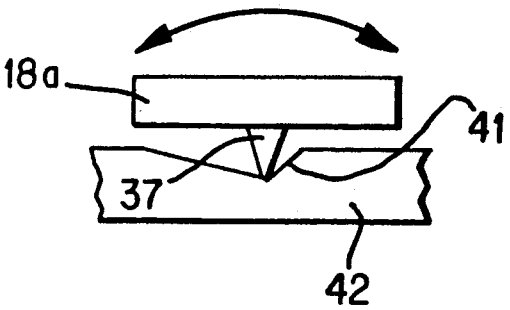
FIGS. 4, 5 and 6 are schematic views of the index mechanism detents.
Figure 4:
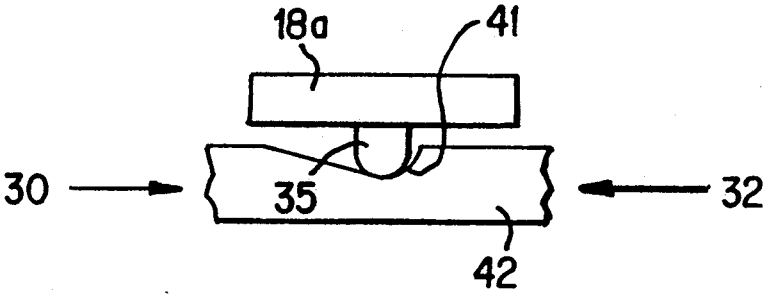
Figure 6:
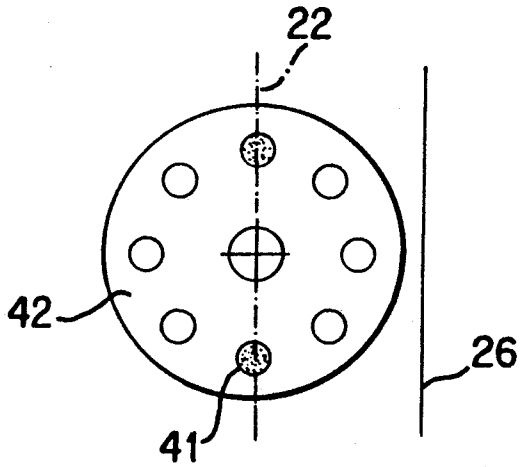

The invention replaces the single blade holder 20 with a multiple turret style blade holder 10 and adapts the blade support and loading arrangement 1 for use with the holder 10. In order to maintain proper blade load and angle, a detent disk 42 is disposed outside a first support arm 18*a* and non-rotatably compression spring mounted (not shown) to the blade holder mounting extension 10*a* (see FIGS. 4–10). The detent disk 42 is configured with shaped edge detents 41, one per blade, to ensure that the force required to rotate the blade holder 10, through the detent disk 42 and mounting extension 10*a*, in the direction of photoreceptor travel 32 is extremely high, effectively preventing all rotation in that direction. Rotation in the opposite direction 30, for indexing, is accomplished with only minimal force, however. Further, the detents 41 are oriented to align with a blade holder pivot axis 22 which is parallel to the plane of the photoreceptor 26 and engaged by the detent pins 35, 37. This detent alignment allows the blade holder 10 to pivot about the blade holder pivot axis 22 and align itself to the photoreceptor plane 26. The detents 41 also serve to lock each blade 12 into position relative to the photoreceptor 26 and the detent disk 42. The detent pins 35, 37 are either a spherical ended or prism shaped pin, respectively, (as seen in FIGS. 4 and 5) to correspond to the detents found on detent disk 42.

Figure 7A:
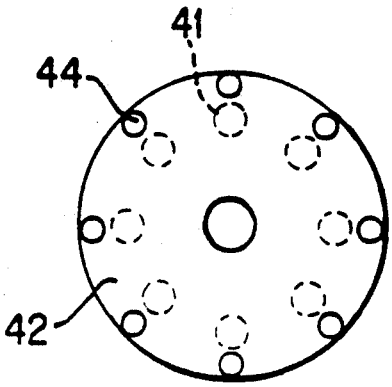
FIG. 7A is a schematic end view depicting an eight blade detent disk showing the relationship between the detents and the index pins.
Figure 7B:
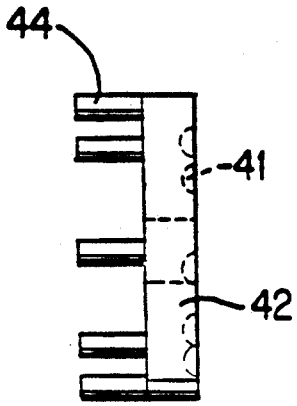
FIG. 7B is a schematic side view depicting an eight blade detent disk showing the relationship between the detents and the index pins.
Figure 8:
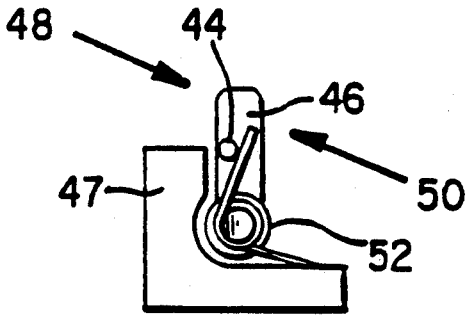
FIG. 8 is a schematic view depicting the index pawl.

As seen in FIGS. 7A and 7B, attached to the detent disk 42 are a plurality of index pins 44, one corresponding to each elastomeric blade 12 on the blade holder 10. In order to index a new cleaning blade 12 into position, the support arms 18 and blade holder 10 are lifted to retract the failed blade from the photoreceptor 26. As the blade holder is retracted, an index pin 44 on the detent disk 42 comes into contact with a pawl 46 attached to a first cleaner end plate 56*a* of the cleaning assembly. The pawl 46 is mounted against a stop 47 and cannot rotate away from the index pin 44. As seen in FIG. 8, the pin 44 is forced to ride up the length of its respective pawl 46 until clearing the top of the pawl. In so doing, the pin 44 rotates the detent disk 42 relative to the support arm 18*a* thereby rotating the blade holder 10. The detent pins 35, 37 are consequently moved out of the failed blade detents as the compression spring expands (not shown) and snapped into the new cleaning blade detents as the index pin 44 clears the top of the pawl 46. As the support arms 18 are lowered back toward the photoreceptor 26, an index pin 44 again contacts the pawl 46. This time, however, the pin 44 swings the pawl 46, which is lightly loaded by spring 52, out of the way. Blade withdrawal direction is indicated by arrow 50 and blade returning direction is indicated by arrow 48. As the blade 12 comes to rest against the photoreceptor 26, the pawl 46 is no longer in contact with the detent disk 42 and the blade 12 is free to pivot about the blade holder pivot axis 22 and align itself to the photoreceptor plane 26.

Figure 11A:
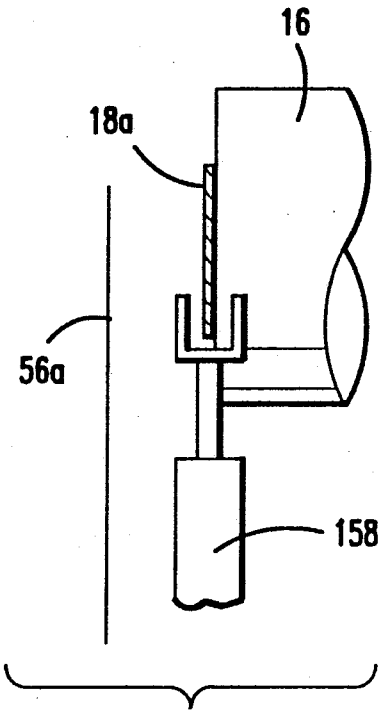
FIG. 11A is a schematic end view of the claimed multiple cleaning blade indexing device as viewed along line 11A—11A shown in FIG. 11.
Figure 11:
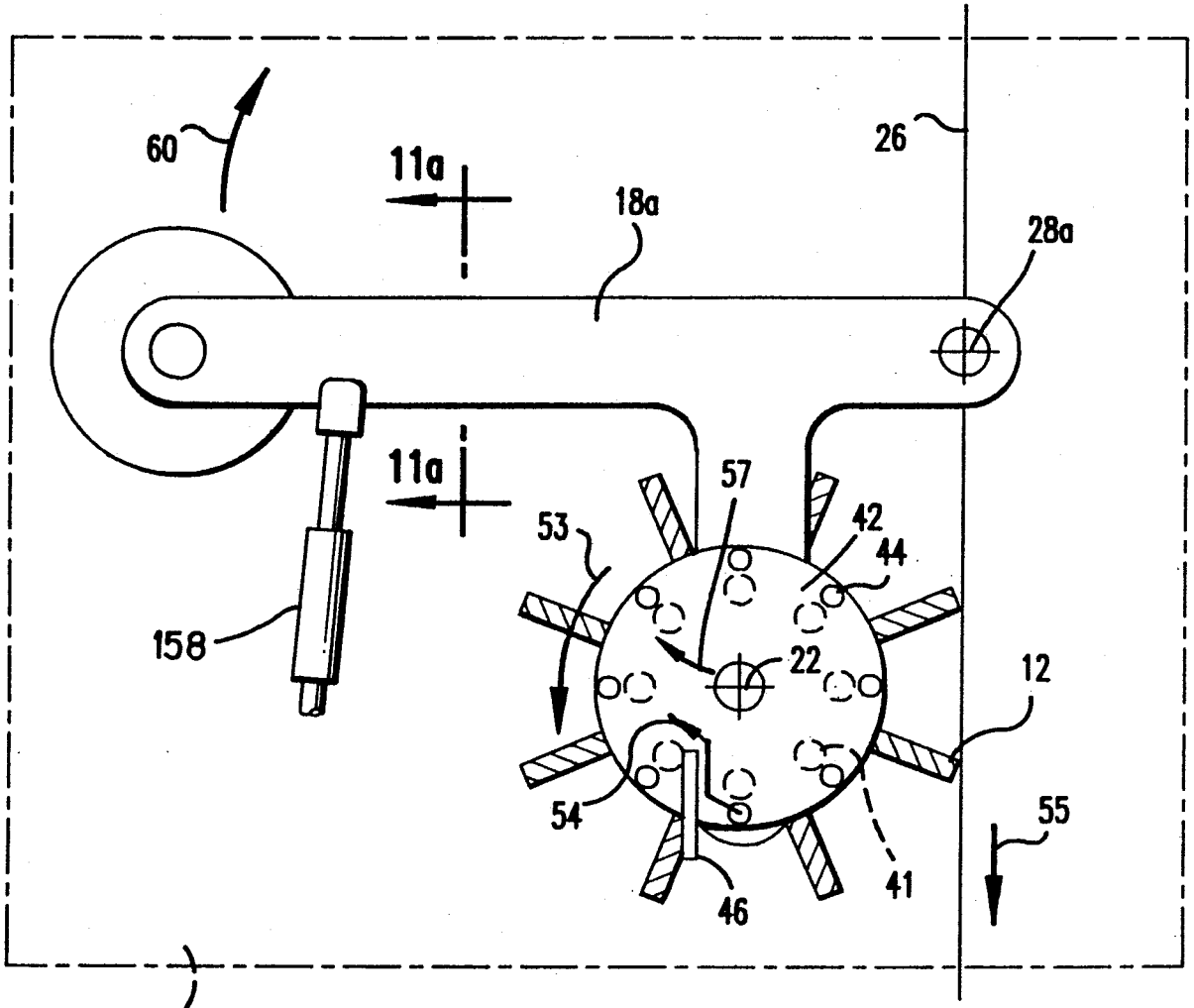
FIG. 11 is a schematic view depicting the claimed multiple cleaning blade indexing device using a solenoid or worm gear for lifting the support arms.

The lifting of the support arms 18 and blade holder 10 can be accomplished preferably by either single rotation cams 58 (see FIGS. 9 and 10), solenoids or worm gears (see FIGS. 11 and 11A). In the preferred embodiment, the cams 58 are rotatably mounted to each cleaner end plate 56*a*, and are interconnected, by means of a cam shaft 58*a*. A motor (not shown) controls the rotation of the cam shaft 58*a*, and the cams 58 which are non-rotatably mounted to cam shaft 58*a*. This interconnection ensures that the cams 58 simultaneously engage both support arms 18 for lifting and disengage from the support arms 18 for releasing the blade holder so that the blade 12 may align with the photoreceptor plane 26. Whatever lifting method is used, however, the lifting mechanism must not be disposed such that it contacts the support arms 18 or blade holder 10 when the blade 12 is in its cleaning position. Separation of the support arms 18 from the lifting means 58 during cleaning operation allows the support arms 18 to pivot on the support arm pivot axis 28 thereby allowing the blade load weight 16 to be fully applied to the loading of the blade 12 without hindrance to blade alignment with the photoreceptor plane 26. FIG. 9 further shows the motion of the support arms 18 during lifting as direction arrow 60, and the direction of cam rotation as arrow 59. Detent disk rotation 53, direction of blade holder movement 57 and index pin motion 54 due to lifting of the support arms 18 are also shown. Note that FIG. 9 is viewed through the near end plate 56*a*, which is shown in dotted-line fashion. Additionally, note that the support arm pivot 28*a* is shown attached to the end plate 56*a*. Finally, FIG. 10 is provided to clearly show the claimed invention as mounted in a xerographic cleaning assembly.

As an alternative to the cams 58 (shown in FIGS. 9 and 10), a solenoid or worm gear, represented by 158, can be mounted to either end plate and driven by a motor so as to engage support arms 18 for lifting and disengaging from the support arms 18.

While the present invention has been described in connection with the preferred embodiment, it will be understood that it is not intended to limit the invention to that embodiment. On the contrary, it is intended to cover all alternatives, modifications and equivalents as may be included within the spirit and scope of the invention as defined by the appended claims.

What is claimed is:

1. A cleaning apparatus for cleaning a moving photoreceptor surface having particles thereon, comprising:

a support and loading means pivotally and rotatably attached to two end plates of the cleaning apparatus for supporting and loading a blade holder, said means further comprising two support arms to which said blade holder is removably attached;

said blade holder further comprising two ends, a mounting extension at each end and a plurality of cleaning blades mounted radially from a central core axis of said blade holder with a first cleaning blade in frictional contact with the moving photoreceptor surface during a cleaning operation to remove particles therefrom;

an indexing means for indexing said blade holder to rotate and position a second cleaning blade into frictional contact with the photoreceptor surface and to space said first mentioned cleaning blade remotely from the photoreceptor surface, said indexing means further comprising a detent disk which is non-rotatably compression spring mounted to said mounting extension and positioned outside a first support arm; and a means for lifting and lowering said support and loading means to index said cleaning blades.

2. The cleaning apparatus of claim 1, wherein said detent disk further comprises shaped edge detents and index pins, one of each per blade, mounted on opposite faces of said detent disk.

3. The cleaning apparatus of claim 2, wherein said first support arm further comprises two detent pins fixed to said first support arm for mating with a pair of said detents.

4. The cleaning apparatus of claim 1, wherein a force required to rotate said blade holder through said detent disk in a direction of photoreceptor travel is extremely high, effectively preventing all rotation in said direction.

5. The cleaning apparatus of claim 1, wherein a force required to rotate said blade holder through said detent disk in a direction opposite to said photoreceptor travel direction, for indexing, is extremely small.

6. The cleaning apparatus of claim 4, wherein said detent disk configured with said shaped edge detents, such that said detents align along a detent axis parallel to said plane of the photoreceptor when said detents are engaged by said detent pins, said detent pin engagement locking said blade in cleaning position and allowing said blade holder to pivot about said blade holder pivot axis to align freely with said photoreceptor plane.

7. The cleaning apparatus of claim 6, wherein said detents position each blade relative to the photoreceptor surface.

8. The cleaning apparatus of claim 1, wherein said blade holder is a multiple turret style cleaning blade holder with a plurality of blades molded to said blade holder.

9. The cleaning apparatus of claim 1, wherein said blade holder is a multiple turret style cleaning blade holder with a plurality of blades assembled to said blade holder.

10. The cleaning apparatus of claim 1, wherein said blade holder rotates during indexing, about said central core axis an amount sufficient to index said second blade into frictional contact with the photoreceptor surface and remove said first blade remotely from the photoreceptor surface for replacement.

11. The cleaning apparatus of claim 1, wherein said blade holder comprises at least two elastomeric cleaning blades.

12. The cleaning apparatus of claim 1, wherein said support arms are mounted relative to said cleaning apparatus end plates such that said support arms are free to pivot about a support arm pivot axis independent of said lifting means.

13. The cleaning apparatus of claim 1, wherein said support arms further comprise a blade load weight, said weight is provided to transfer a force through said support arms to supply a cleaning blade load to said blade during cleaning operation.

14. The cleaning apparatus of claim 3, wherein said detent pins are spherical shaped.

15. The cleaning apparatus of claim 3, wherein said detent pins are prism shaped.

16. The cleaning apparatus of claim 1, wherein said lifting means is comprised of at least one of the group consisting of a single rotation cam, a solenoid and a worm gear.

17. A cleaning apparatus for cleaning a moving photoreceptor surface having particles thereon, comprising:

a support and loading means pivotally and rotatably attached to two end plates of the cleaning apparatus for supporting and loading a blade holder, said means further comprising two support arms to which said blade holder is removably attached;

said blade holder further comprising two end, a mounting extension at each end and a plurality of cleaning blades mounted radially from a central core axis of said blade holder with a first cleaning blade in frictional contact with the moving photoreceptor surface during a cleaning operation to remove particles therefrom;

an indexing means for indexing said blade holder to rotate and position a second cleaning blade into frictional contact with the photoreceptor surface and to space said first mentioned cleaning blade remotely from the photoreceptor surface; and a means for lifting and lowering said support and loading means, attached to said end plates, to index said cleaning blades, said indexing means further comprising a pawl attached to a first end plate and lightly spring loaded against a stop, also attached to said first end plate.

18. The cleaning apparatus of claim 17, wherein said indexing means further comprising, a detent disk which is non-rotatably compression spring mounted to said mounting extension and positioned outside a first support arm.

19. The cleaning apparatus of claim 18, further comprising shaped edge detents and index pins, one of each per blade, mounted on opposite faces of said detent disk.

20. The cleaning apparatus of claim 19, wherein said first support arm further comprises two detent pins fixed to said first support arm for mating with a pair of said detents.

21. The cleaning apparatus of claim 18, wherein a force required to rotate said blade holder through said detent disk in a direction of photoreceptor travel is extremely high, effectively preventing all rotation in said direction.

22. The cleaning apparatus of claim 18, wherein a force required to rotate said blade holder through said detent disk in a direction opposite to said photoreceptor travel direction, for indexing is extremely small.

23. The cleaning apparatus of claim 20, wherein said detent disk configured with said shaped edge detents, such that said detents align along a detent axis parallel to said plane of the photoreceptor when said detents are engaged by said detent pins, said detent pin engagement locking said blade in cleaning position and allowing said blade holder to pivot about said blade holder pivot axis to align freely with said photoreceptor plane.

24. The cleaning apparatus of claim 17, wherein said blade holder is a multiple turret style cleaning blade holder with a plurality of blades molded to said blade holder.

25. The cleaning apparatus of claim 17, wherein said blade holder is a multiple turret style cleaning blade holder with a plurality of blades assembled to said blade holder.

26. The cleaning apparatus of claim 17, wherein said support arms are mounted relative to said cleaning apparatus end plates such that said support arms are free to pivot about a support arm pivot axis independent of said lifting means.

* * * * *